US010640312B2

(12) United States Patent
Sands

(10) Patent No.: US 10,640,312 B2
(45) Date of Patent: May 5, 2020

(54) FRICTION FEEDING SEPARATING SYSTEM

(71) Applicant: Superior Product Handling Solutions, Inc., Brooklyn Park, MN (US)

(72) Inventor: Steven G. Sands, Plymouth, MN (US)

(73) Assignee: Superior Product Handling Solutions, Inc., Brooklyn Park, MN (US)

( * ) Notice: Subject to any disclaimer, the term of this patent is extended or adjusted under 35 U.S.C. 154(b) by 0 days.

(21) Appl. No.: 15/850,004

(22) Filed: Dec. 21, 2017

(65) Prior Publication Data

US 2019/0193966 A1 Jun. 27, 2019

(51) Int. Cl.

| | |
|---|---|
| ***B65H 3/06*** | (2006.01) |
| ***B65H 7/20*** | (2006.01) |
| ***B65H 3/04*** | (2006.01) |
| ***B65H 3/52*** | (2006.01) |

(52) U.S. Cl.

CPC ..... *B65H 3/0623* (2013.01); *B65H 3/042* (2013.01); *B65H 3/0669* (2013.01); *B65H 3/5284* (2013.01); *B65H 7/20* (2013.01); *B65H 2511/416* (2013.01); *B65H 2513/10* (2013.01); *B65H 2513/41* (2013.01); *B65H 2513/50* (2013.01); *B65H 2551/18* (2013.01)

(58) Field of Classification Search

CPC ..... B65H 3/0623; B65H 3/0669; B65H 2551/18; B65H 2513/10; B65H 2513/41; B65H 2513/50

See application file for complete search history.

(56) References Cited

U.S. PATENT DOCUMENTS

| | | | |
|---|---|---|---|
| 1,637,833 | A | 8/1927 | Mueller |
| 1,919,238 | A | 7/1933 | Mccarthy |
| 3,291,482 | A | 12/1966 | Stemmler |

(Continued)

FOREIGN PATENT DOCUMENTS

| | | | |
|---|---|---|---|
| DE | 3636935 | A | 5/1988 |
| WO | WO 8200994 | A1 | 4/1982 |

OTHER PUBLICATIONS

Prosecution History for U.S. Appl. No. 13/835,412 including: Issue Notification dated Dec. 9, 2015, Notice of Allowance dated Sep. 14, 2015, Amendment dated Jun. 15, 2015, Non-Final Office Action dated Mar. 19, 2015, Amendment with RCE dated Mar. 4, 2015. Final Office Action dated Dec. 23, 2014, Amendment dated Oct. 7, 2014, and Non-Final Office Action dated Jul. 30, 2014, 88 pages.

*Primary Examiner* — Patrick Cicchino

(74) *Attorney, Agent, or Firm* — Christopher J. Volkmann; Kelly, Holt & Christenson, PLLC

(57) ABSTRACT

A friction sheet feeding machine is provided. The friction sheet feeding machine comprises a hopper configured to hold a stack of items. The friction sheet feeding machine also comprises a receiver configured to receive an item from the stack of items. The friction sheet feeding machine also comprises a separating mechanism configured to separate the item from the stack of items. The separating mechanism comprises a drive mechanism. The drive mechanism is configured to operate in a forward direction and a reverse direction. The friction sheet feeding machine also comprises a controller configured to generate signals to the drive mechanism to operate in the forward direction for a first period of time, and in the reverse direction for a second period of time.

20 Claims, 18 Drawing Sheets

(56) References Cited

U.S. PATENT DOCUMENTS 3,664,660 A 5/1972 Runzi
3,933,350 A 1/1976 Mignano
4,014,537 A 3/1977 Stange
4,457,507 A 7/1984 Ishikawa et al.
4,573,673 A 3/1986 Haug
4,718,809 A 1/1988 Krasuski et al.
4,720,960 A 1/1988 Green
4,991,831 A 2/1991 Green
5,062,600 A 11/1991 Holbrook et al.
5,143,365 A 9/1992 Green
5,192,069 A 3/1993 Seymour et al.
5,244,198 A 9/1993 Green
5,601,282 A 2/1997 Milo et al.
5,642,877 A 7/1997 Green
5,772,199 A 6/1998 Green
5,779,234 A * 7/1998 Tomii ..... B41J 13/106 271/119
5,888,047 A 3/1999 Auerbach et al.
6,086,061 A 7/2000 Vedoy et al.
6,402,135 B1 6/2002 Werner
6,416,047 B1 7/2002 Pfankuch
6,499,731 B2 12/2002 Werner
6,572,102 B2 6/2003 Vedoy
6,601,841 B1 8/2003 Werner
6,932,338 B1 8/2005 Popejoy et al.
7,007,945 B2 * 3/2006 Hiramitsu ..... B65H 3/0623 271/122
7,303,188 B2 12/2007 Malatesta
7,419,154 B2 9/2008 Pelletier et al.
7,494,120 B2 * 2/2009 Shimizu ..... B41J 11/0095 271/126
7,527,256 B1 5/2009 Kaiping
7,624,978 B2 12/2009 Kaiping
7,628,393 B2 * 12/2009 Mitsuya ..... B65H 3/0653 271/10.01
7,708,267 B2 * 5/2010 Shigeno ..... B65H 3/0661 271/114
7,726,643 B2 6/2010 Werner
7,748,696 B2 7/2010 Kaiping
7,850,163 B2 12/2010 Kaiping
8,235,380 B2 8/2012 Claris
8,397,899 B2 3/2013 Krause et al.
9,221,629 B1 12/2015 Sands et al.
9,505,572 B1 * 11/2016 Asaro ..... G06K 15/16
9,624,053 B2 * 4/2017 Otsuka ..... B41J 13/103
2004/0051230 A1 3/2004 Tanaka et al.
2009/0206542 A1 8/2009 Popejoy et al.
2010/0201062 A1 8/2010 Popejoy et al.
2011/0291348 A1 12/2011 Kaiping
2018/0118480 A1 * 5/2018 Kuriki ..... B65H 3/063
2018/0201455 A1 * 7/2018 Nameroff ..... B65H 3/5207

* cited by examiner

FRICTION FEEDING SEPARATING SYSTEM

BACKGROUND

A wide variety of friction sheet feeding machines are available for feeding individual sheets from the bottom of an essentially vertical stack of sheets. These machines typically include a friction retard surface positioned above a driven friction roller.

Friction retard surfaces have a wide variety of sizes, shapes, contours, coefficients of friction, etc. Friction retard surfaces have been employed over the years, in a rotating fashion, with the retard roller rotated in a forward direction on some machines, and rotated in a reverse direction in others. While a forward rotating friction retard roller provides significant advantages when feeding certain types of sheets, such as course flat product, and a reverse rotating friction retard roller provides significant advantages when feeding other types of sheets, such as coated, glossy, printed product, the direction of rotation limits the types of sheets which may be reliably fed through the friction sheet feeding mechanism.

SUMMARY

A friction sheet feeding machine is provided. The friction sheet feeding machine comprises a hopper configured to hold a stack of items. The friction sheet feeding machine also comprises a receiver configured to receive an item from the stack of items. The friction sheet feeding machine also comprises a separating mechanism configured to separate the item from the stack of items. The separating mechanism comprises a drive mechanism. The drive mechanism is configured to operate in a forward direction and a reverse direction. The friction sheet feeding machine also comprises a controller configured to generate signals to the drive mechanism to operate in the forward direction for a first period of time, and in the reverse direction for a second period of time.

DETAILED DESCRIPTION OF ILLUSTRATIVE EMBODIMENTS

Figure 1A:
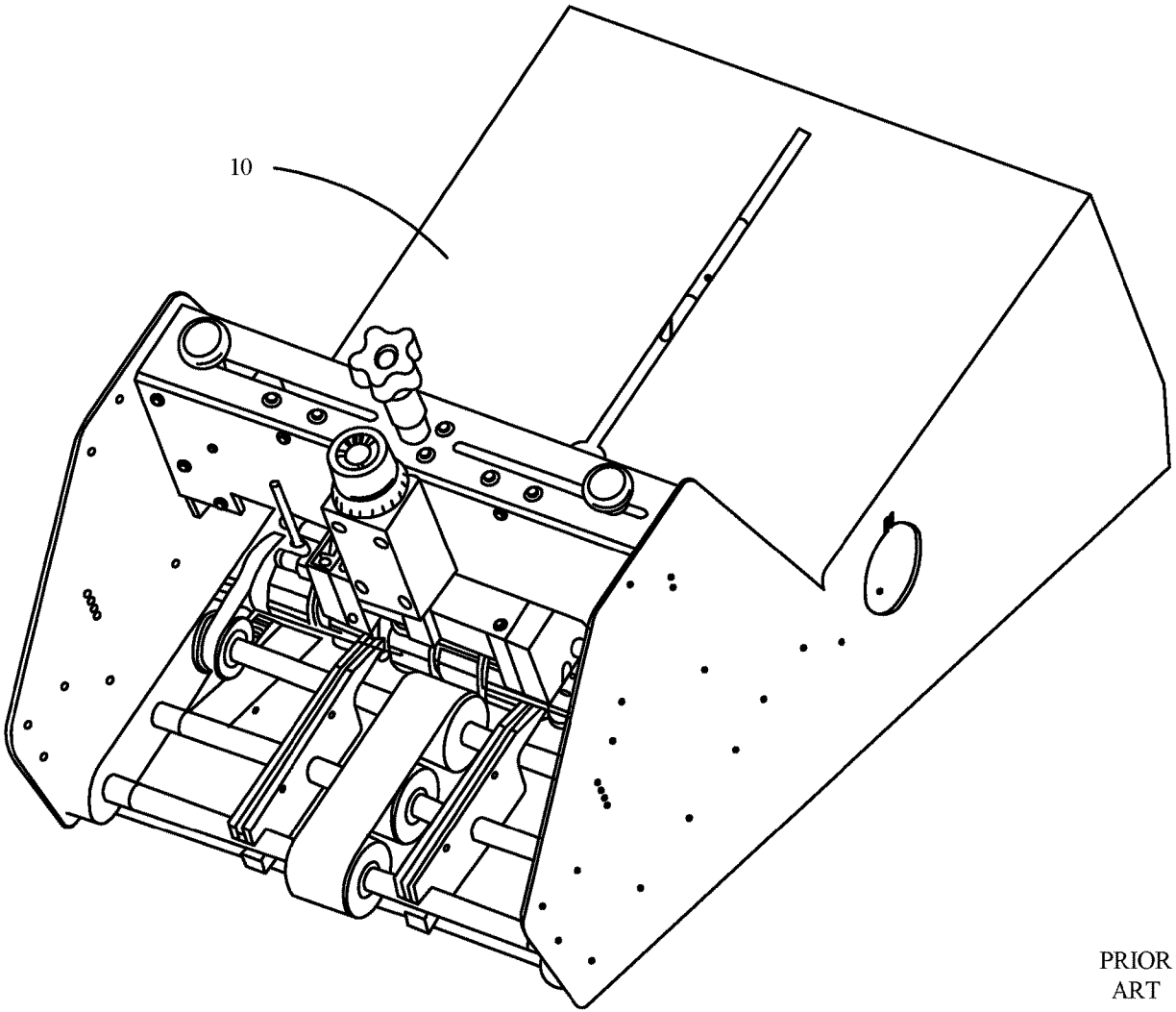
PRIOR ART FIG. 1A
FIGS. 1A and 1B illustrate perspective views of a prior art friction sheet feeding machine.
Figure 1B:
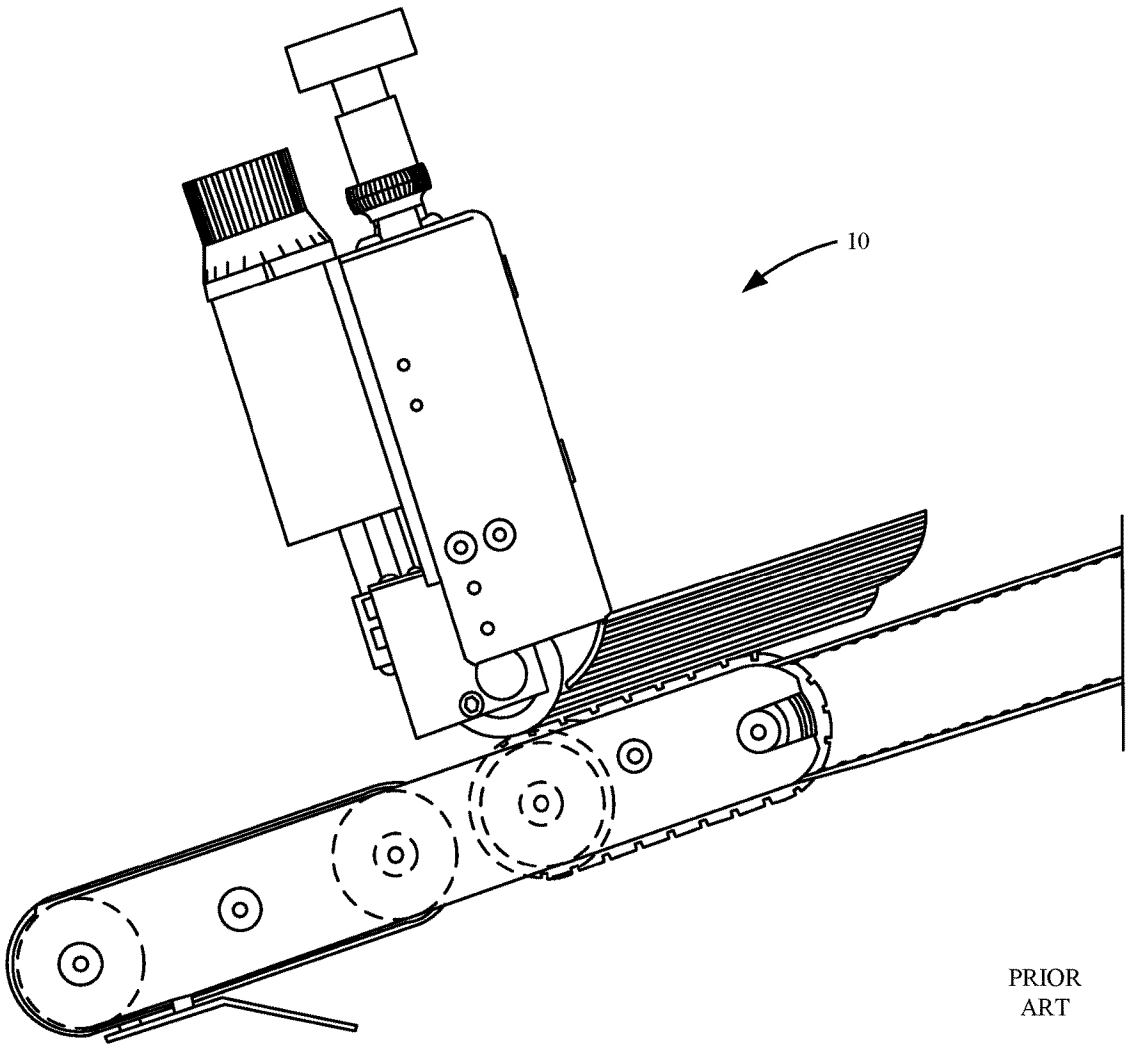

FIGS. 1A and 1B illustrate perspective views of a prior art friction sheet feeding machine. U.S. Pat. No. 6,932,338, entitled "Friction Sheet Feeding Machine with Reversible Driven Retard Roller," incorporated herein by reference, illustrates one example of a reversible retard roller in accordance with the prior art. Friction sheet feeding machine 10 includes a frame, a tray assembly, a drive assembly, a gating assembly, and a height adjustment system. Machine 10 is capable of serially feeding individual sheets in a lateral direction from the bottom of a generally vertical stack of sheets retained within a tray assembly. A tray assembly is effective for holding a stack of individual sheets in a substantially vertical position with a slight biasing of at least the lower portion of the stack towards the friction feed rollers and the friction retard roller.

Generally, a drive assembly of friction sheet feeding machine 10 includes a primary drive motor and one or more friction feed rollers driven by the primary drive motor. The friction feed rollers can directly contact the sheets of paper, or can be used to drive a friction belt which contacts the sheets directly.

As illustrated in FIGS. 1A and 1B, one prior art embodiment of a suitable drive assembly 10 includes a primary drive motor and a plurality of laterally aligned and laterally spaced friction belts each mounted to a drive friction feed roller and an idler motor which is longitudinally aligned and longitudinally spaced with each associated friction feed roller. The friction feed rollers are mounted on a laterally extending first support rod which is rotatably attached to side panels of the frame. Similarly, idler rollers are mounted on a laterally extending second support rod, which is longitudinally spaced from the first support rod and also rotatably attached to the side panels of the frame. The first support rod is driven by the primary drive motor via a drive belt. As also shown in FIGS. 1A and 1B, drive assembly 10 also includes a conveyor system downstream from the friction belts, which receives individual sheets fed from the sheets stacked by the friction belts and conveys the fed sheets to the desired location. The sheets are typically fed to a conveyor belt, time to receive and collate sheets fed from the several aligned friction sheet feeding machines.

Friction sheet feeding machine 10 also includes a gate assembly which includes a friction retard roller driven by an auxiliary electric motor, with the direction of rotation of the retard rollers being reversible as between a forward (concurrent) direction and a reverse (countercurrent) direction so as to permit customized operation of the friction sheet feeding machine to accommodate feeding of a wide variety of different sheets. The ability to reverse the rotational direction of the driven friction retard rollers allows for the retard rollers to rotate concurrently with the friction feed rollers when in a first state and rotate countercurrent to the friction feed rollers when in a second state.

Figure 2A:
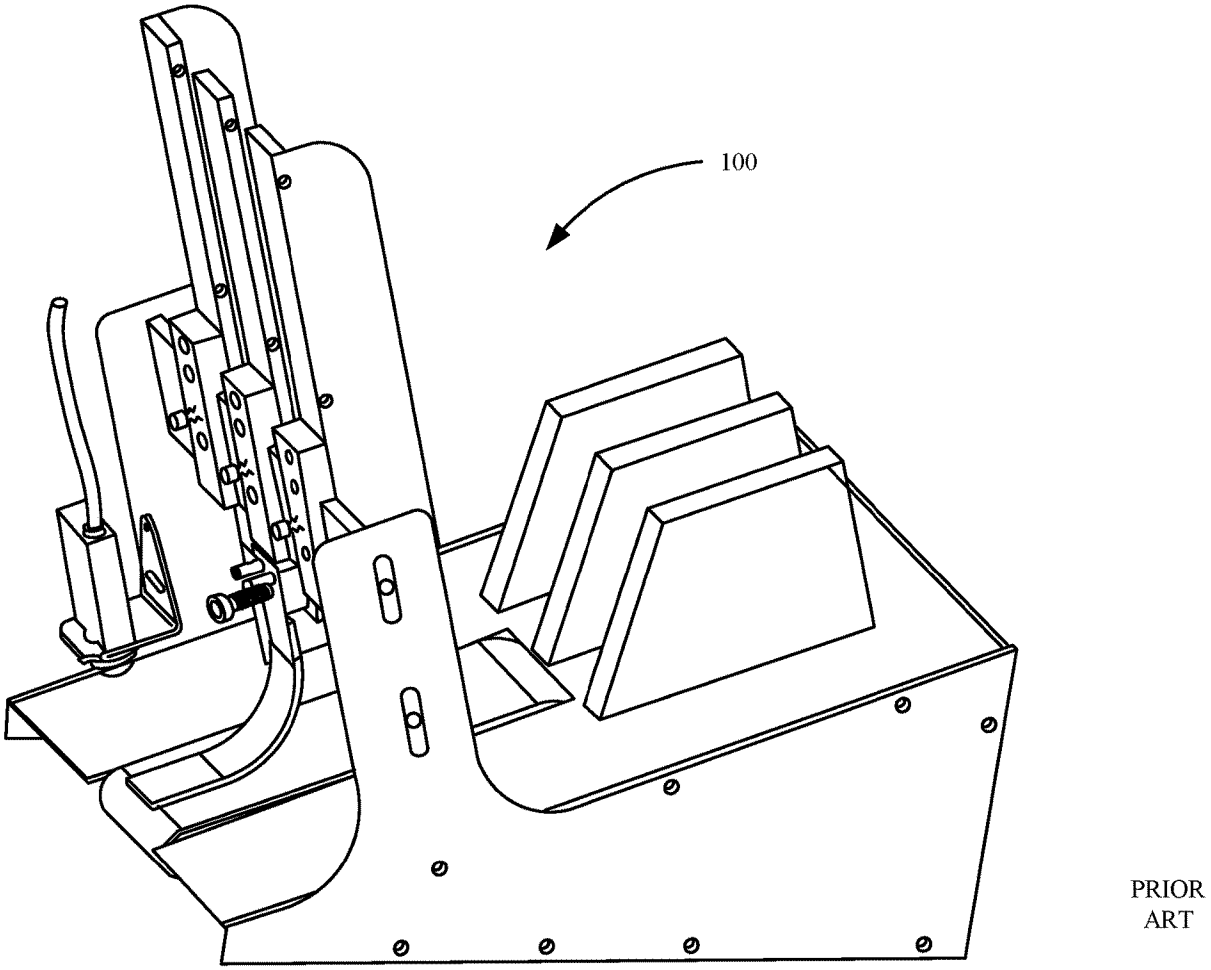
FIGS. 2A and 2B are a perspective view of a friction feeder in accordance with the prior art.
Figure 2B:
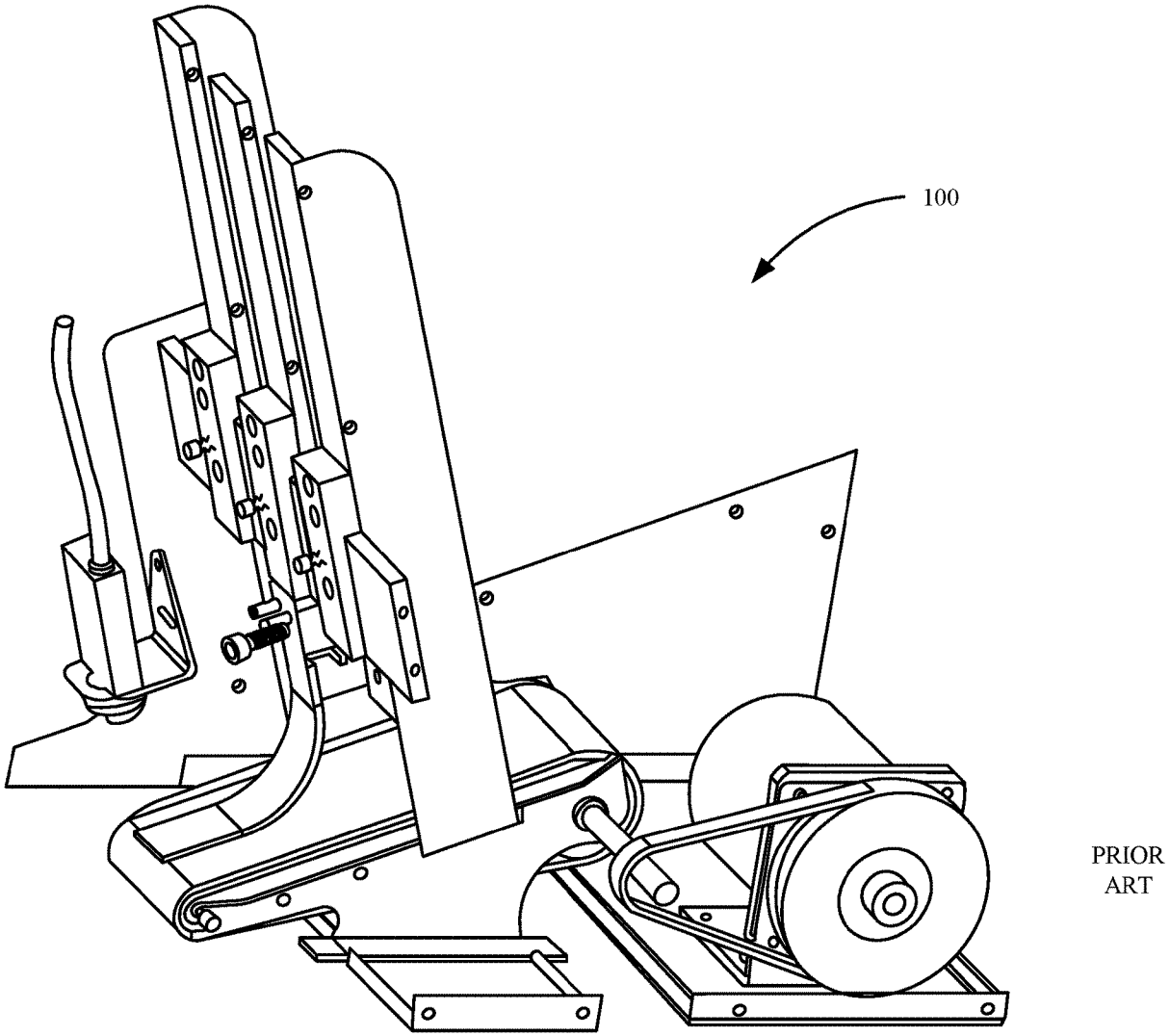

FIGS. 2A and 2B are a perspective view of a friction feeder in accordance with the prior art. As described in U.S. Pat. No. 9,221,629, entitled "Friction Feeder," which is incorporated herein by reference, a friction feeder 100, as shown in FIGS. 2A and 2B, illustratively includes a bin or hopper assembly for holding a stack of items in a generally vertical position. Friction feeder 100 is configured to separate the items in the stack such that they are individually fed, or conveyed, into a processor container, such as, but not limited to envelopes. Some processes include, but are not limited to, collation, labeling, and/or mailing processes.

The items in a stack can be virtually any desired material and can have the same or different thicknesses. For example, but not by limitation, the items can comprise single sheets of paper and/or multiple sheets of paper, such as brochures, magazines, etc. In one example, the items can include greeting and novelty cards, envelopes, collapsed cartons, folded and open edged documents, tri-fold and Z-fold documents, blister cards, die cuts, etc. Friction feeder 100 can also feed non-paper based items, such as plastic cards, cassettes, CDs, etc. Friction feeder 100 is configured to handle items of varying thicknesses without requiring user intervention to adjust components of friction feeder 100.

Illustratively, feeder 100 is configured to convey materials at a high speed, e.g. greater than or equal to 100 feet/minute. In one particular example, a high speed feeder conveys material at more than 200 feet/minute, or more than 300 feet/minute. Of course, feeder 100 can be configured to convey materials at speeds less than 100 feet/minute as well.

In the illustrated machine of FIGS. 2A and 2B, friction feeder 100 includes a drive assembly having a conveying belt configured to engage a surface of a bottom item in the hopper. The belt is rotated by a motor and is formed of material having sufficient friction characteristics such as, but not limited to, urethane, natural gum rubber, composite gum rubber, and/or other elastomers configured to move the bottom item in a forward feed direction. The belt is driven by the motor using a timing belt. Additionally, or alternatively, the drive assembly can include friction drive wheels or other suitable mechanisms configured to engage and move the items from the stack.

Friction feeder 100 includes a gate assembly having a separating member that engages items in the stack and is configured to separate the bottom item being conveyed by the belt in a forward direction from the other items in the stack. The hopper includes a guide assembly that biases the items towards the separating member. Illustratively, the guide assembly includes one or more wedge members having an item-engaging surface. The surface can be any suitable shape including planar or curved portions.

While feeding mechanisms are known from the prior art, for example U.S. Pat. No. 6,932,338, as well as U.S. Pat. No. 9,221,629, there are still some problems with the separating process. There is a need to improve separation and feeding of loose and unbound products that have an inherent tendency to adhere or stick together. For example, some products may be more inclined to stick together because of static, coefficient of friction, magnetism, adhesive properties, or other features.

As described above, current friction feeding mechanisms operate to resolve stickiness between products by having the separator mechanism rotate in either the forward direction or the reverse direction for a given feed cycle, a fixed rate of speed. The rotation aids in creating uniform wear of the separator mechanism, but is not always sufficient to separate difficult products.

There is a need for a separating mechanism that can both have an adjustable rate of rotation, and an ability to allow rotation to be set in both the forward and reverse direction during a given feed cycle. It is also desired to have a system that allows for the pattern of rotation direction, and duration of rotation, to be adjusted by a user. It may also be useful for a separator roller that can be programmable by a user, for example using software and an appropriate user interface. The separator should also be able to run in both the forward and reverse direction, with the rate of rotation set by a customer.

Additionally, the separator should be able to run in both the forward direction and the reverse direction within a single cycle of dispensing a single item. Additionally, it is desired to have the direction and length of rotation set multiple times, and in varying combinations within the cycle of dispensing a single piece. For example, a separator may rotate forward for x-milliseconds, rotate in reverse for y-milliseconds, then rotate in reverse for z-milliseconds, then rotate forward for a-milliseconds. At least some embodiments described herein address at least some of the needs described.

Figure 3:
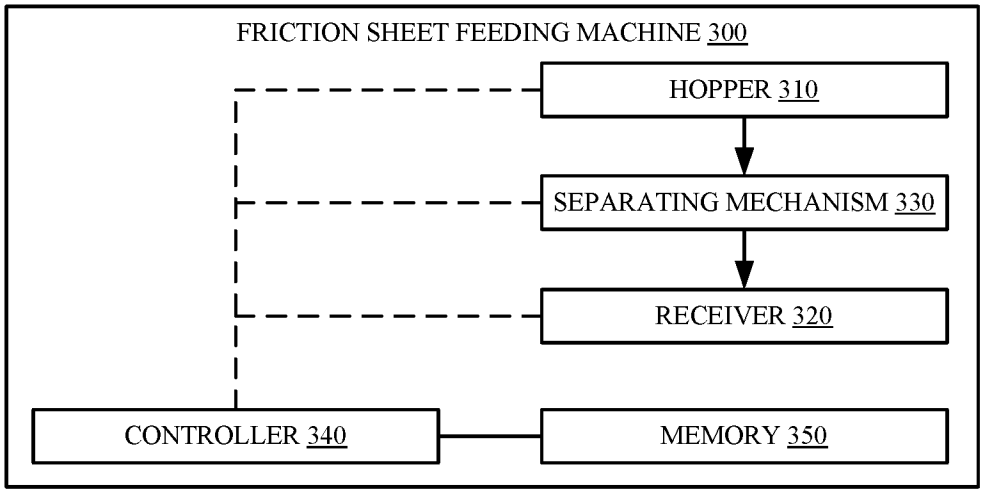
FIG. 3 illustrates a block diagram of a friction sheet feeding machine in accordance with one embodiment of the present invention.

FIG. 3 illustrates a block diagram of a friction sheet feeding machine in accordance with one embodiment of the present invention. As illustrated in FIG. 3, friction sheet feeding machine 300 comprises a hopper 310 and a receiver 320. Separating mechanism 330, in one embodiment, is configured to separate a single item from hopper 310 for delivery to receiver 320. In one embodiment, controller 340 may control operation of hopper 310, separating mechanism 330, and receiver 320. However, while a single controller 340 is illustrated, in other embodiments each component is controlled by an individual controller 340. In one embodiment, controller 340 is configured to control operation of separating mechanism 330 such that only a single item is separated from hopper 310 and delivered to receiver 320 at a single time. Controller 340 may operate, in one embodiment, based on user input for a given operation. In another embodiment, controller 340 may operate based on a retrieved program, stored in a memory 350 associated with friction sheet feeding machine 300. Memory 350 could be stored, for example, within a data storage unit of the friction sheet feeding machine 300, as illustrated in FIG. 3 or may be retrievable from a cloud-based data storage system in one embodiment.

Figure 4:
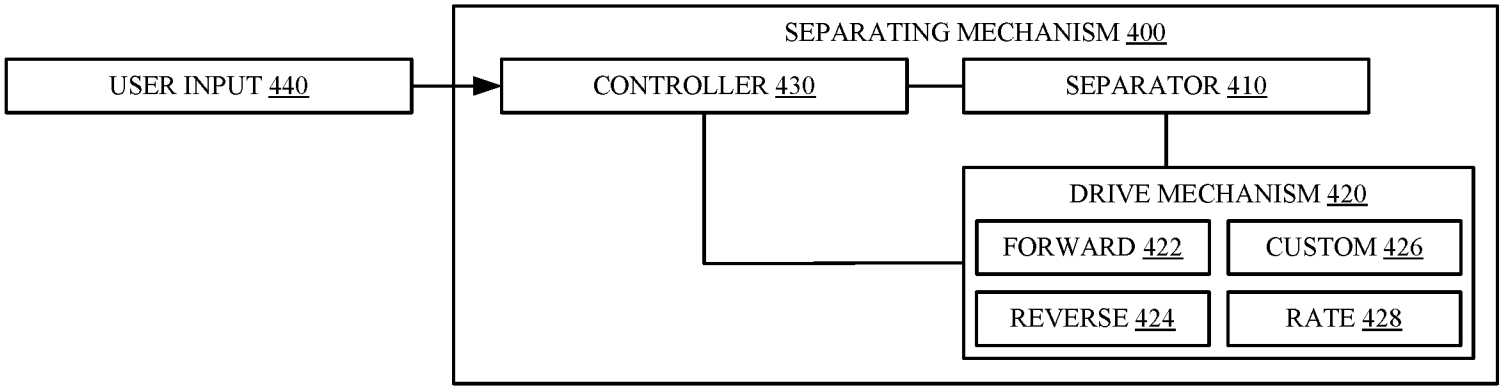
FIG. 4 illustrates a block diagram of a separating mechanism in accordance with one embodiment of the present invention.

FIG. 4 illustrates a block diagram of a separating mechanism in accordance with one embodiment of the present invention. Separating mechanism 400 may, in one embodiment, function similarly to separating mechanism 330, described above with respect to FIG. 3. In one embodiment, based on a received user input 440, a controller 430 sends signals to both separator 410 and drive mechanism 420. Drive mechanism 420 may be configured to drive the separator 410, for example, at a rate 428 set by controller 430 based on user input 440. However, in another embodiment, rate 428 is set at least in part by specifications retrieved by controller 430 from a memory component (e.g. local or remote memory 350, as described with respect to FIG. 3).

Drive mechanism 420 may be configured to operate in both a forward direction 422, and a reverse direction 424. In one embodiment, drive mechanism 420 can operate in both forward 422 and reverse 424 directions during a single separation operation. User input 440 may, in one embodiment, specify that controller 430 set drive mechanism 420 to operate in a customized operation 426, for example alternating between forward and reverse directions during a single separation operation, or at different rates of forward and reverse direction during a given separation option.

Figure 5:
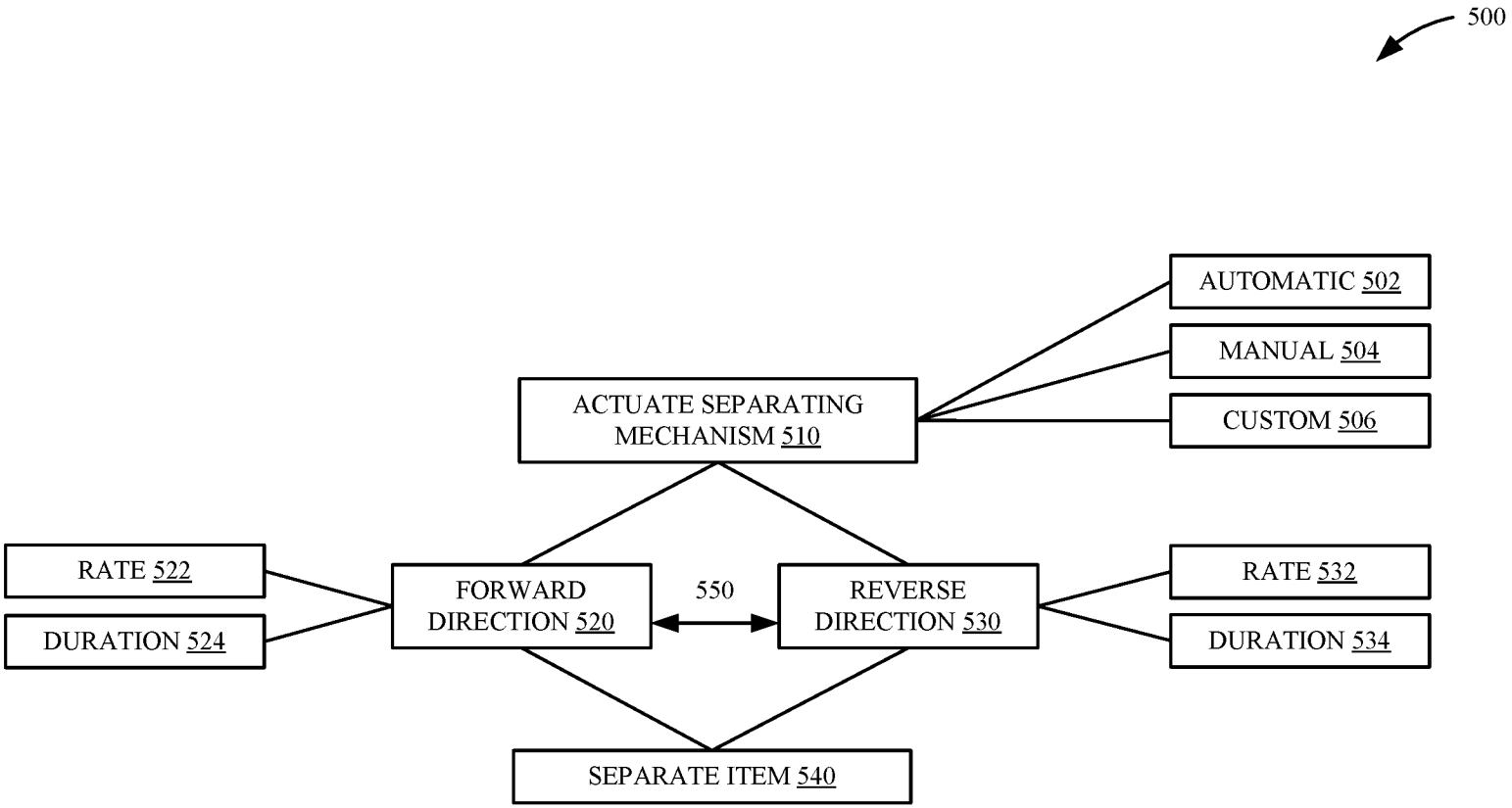
FIG. 5 illustrates an example method of separating items in accordance with one embodiment of the present invention.

FIG. 5 illustrates an example method of separating items in accordance with one embodiment of the present invention. Method 500 may be used to separate a first item from a second item within a stack of items.

In block 510, a separating mechanism is actuated. Actuation of the separating mechanism can occur automatically, as indicated in block 502, manually as indicated in block 504, or in a customized manner, as indicated in block 506. For example, in one embodiment, a customer may pre-set order of operations for actuating a separation mechanism based on known properties of the items being separated. Actuating a separating mechanism, in one embodiment, comprises retrieving a separation sequence for actuation, for example from a local or remote data storage. In another embodiment, actuation of a separating mechanism comprises automatic actuation based on a detected jam. In a further embodiment, actuation is triggered based on a preset condition.

In block 520, the separating mechanism is rotated in a forward direction at a rate 522 for a duration 524. For example, the separating mechanism can rotate forward for a duration of more than 1 millisecond. In another example, the separating mechanism rotates in a forward duration for less than 10 milliseconds.

In block 530, the separating mechanism is rotated in a reverse direction at a rate 532 for a duration 534. For example, the separating mechanism can rotate reverse for a duration of more than 1 millisecond. In another example, the separating mechanism rotates in a reverse duration for less than 10 milliseconds.

As indicated by arrow 550, in one embodiment, a separating mechanism may alternatively operate in a forward and reverse direction, and may do so at different rates of speed, for different durations of time, during a single separation process. In one embodiment, the specific order of operations for forward and reverse rotational directions is set by a user using a user interface and applied to every item being separated. In another embodiment, operation may be dictated in a pre-set manner based on a detected item being separated from a detected stack.

In block 540, the item is separated from a stack in the hopper. Separation may also comprise delivery of the separated item to a receiver or a receiving area. Separation may, in one embodiment, trigger an end of a separation sequence. For example, a separation sequence may comprise, as indicated by arrow 550, alternating between rotation in a forward and reverse direction until separation is detected.

Figure 6:
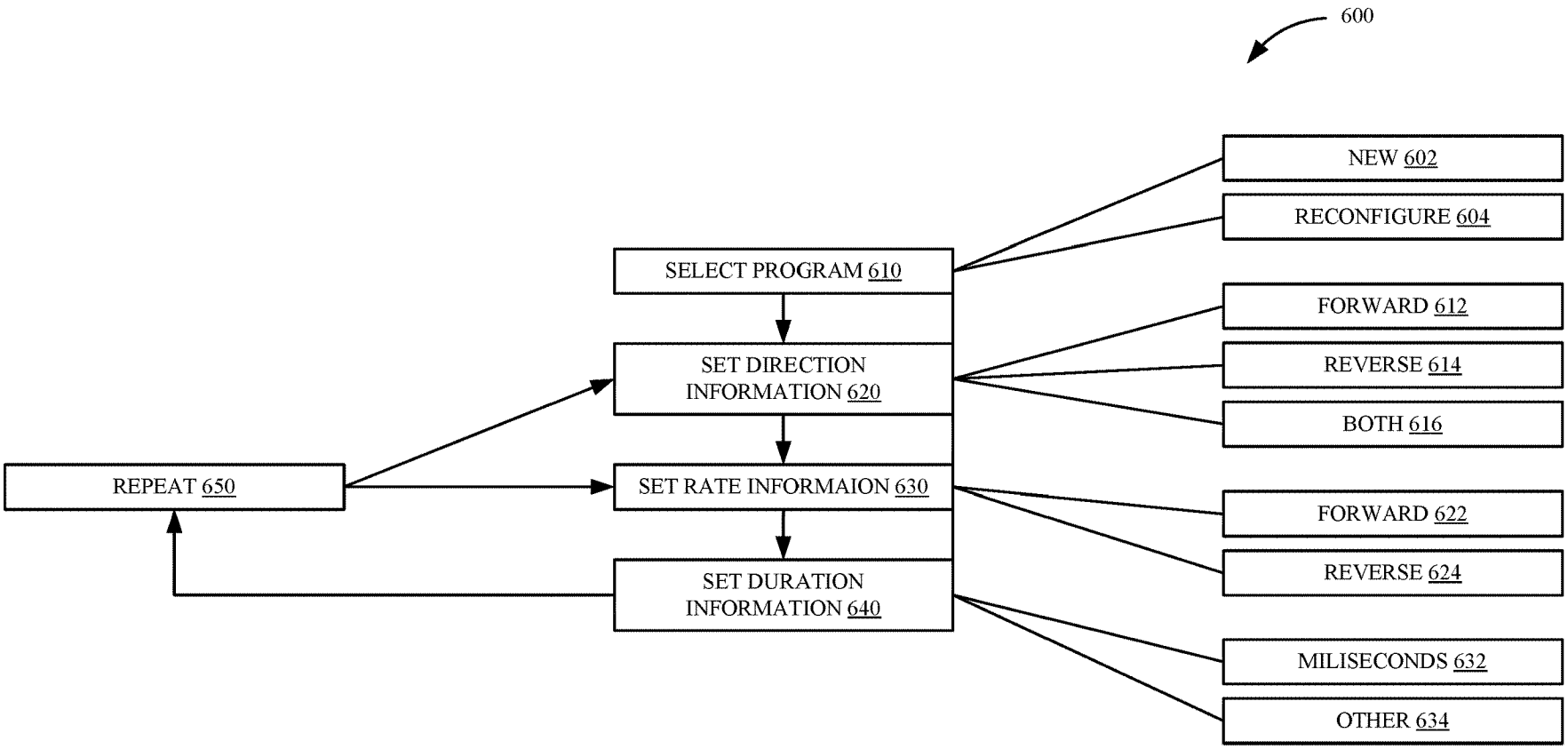
FIG. 6 illustrates an example method of programming movement for a separation mechanism in accordance with an embodiment of the present invention.

FIG. 6 illustrates an example method of programming movement for a separation mechanism in accordance with an embodiment of the present invention. Method 600 may be used to create a program for a controller to use to generate and send signals to a separation drive mechanism in order to separate received material.

In block 610, a program is selected. The program may be selected, for example, based on a current separation of a first item from a second item. For example, based on known parameters of the first and second item, one separation sequence may be selected over another. The program may be a new program, as indicated in block 602, or may be a reconfiguration of an old program, as indicated in block 604. For example, if a current program is not working to separate a first item from a second item within a stack, the program may be reconfigured. In another example, when a new stack of items is received for separation, it may be necessary to program a new program for separation as indicated in block 602, based on known parameters of the stack of items, for example.

In block 620, directional information is set. In one embodiment, the separation mechanism is configured to operate in either a forward direction, as indicated in block 612, a reverse direction, as indicated in block 614, or in both directions as indicated in block 616.

In block 630, rate information for the separation mechanism can be set. For example, rate information can be set for a forward operation, as indicated in block 622, or a reverse operation, as indicated in block 624.

Duration information is set, as indicated, in block 640. Duration of rotation may be set in units of milliseconds, as indicated in block 632, or other appropriate units, as indicated in block 634.

The steps of setting directional, rate, and durational information can be repeated, as indicated in block 650, as many times as necessary to complete the operation. For example, as described earlier, a separation mechanism can comprise alternating between forward and reverse direction at different rates of speed, and for different durations of time, in order to ensure complete separation of an item from the bottom of a stack in a hopper.

FIGS. 7A-F illustrate views of a friction feeder in accordance with one embodiment of the present invention. However, while FIGS. 7A-F illustrate one embodiment of a friction feeder 700, other configurations may also be possible as described above.

Figure 7A:
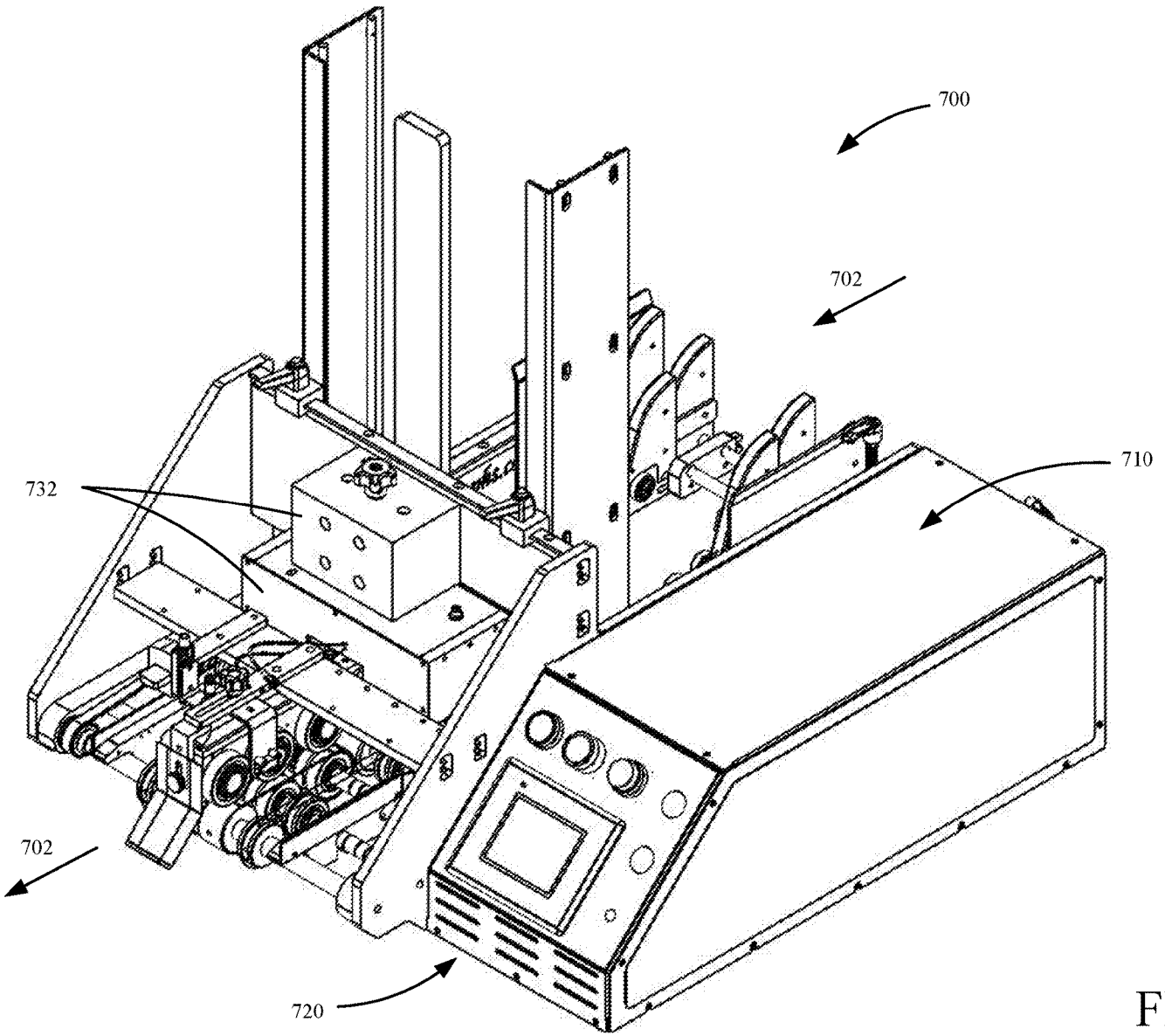
FIGS. 7A-F illustrate views of a friction feeder in accordance with one embodiment of the present invention.

FIG. 7A illustrates a perspective view of a friction feeder 700, in which items move in the direction indicated by arrow 702. Friction feeder 700 comprises a motor located within housing 710, configured to drive a separation mechanism, for example located behind component 732. The roller can be controlled by a controller, for example accessed through interface 720, and house within housing 710. User interface 720 may be configured to receive user input, for example through a screen or user-actuatable input mechanisms, as illustrated in FIG. 7A.

Figure 7B:
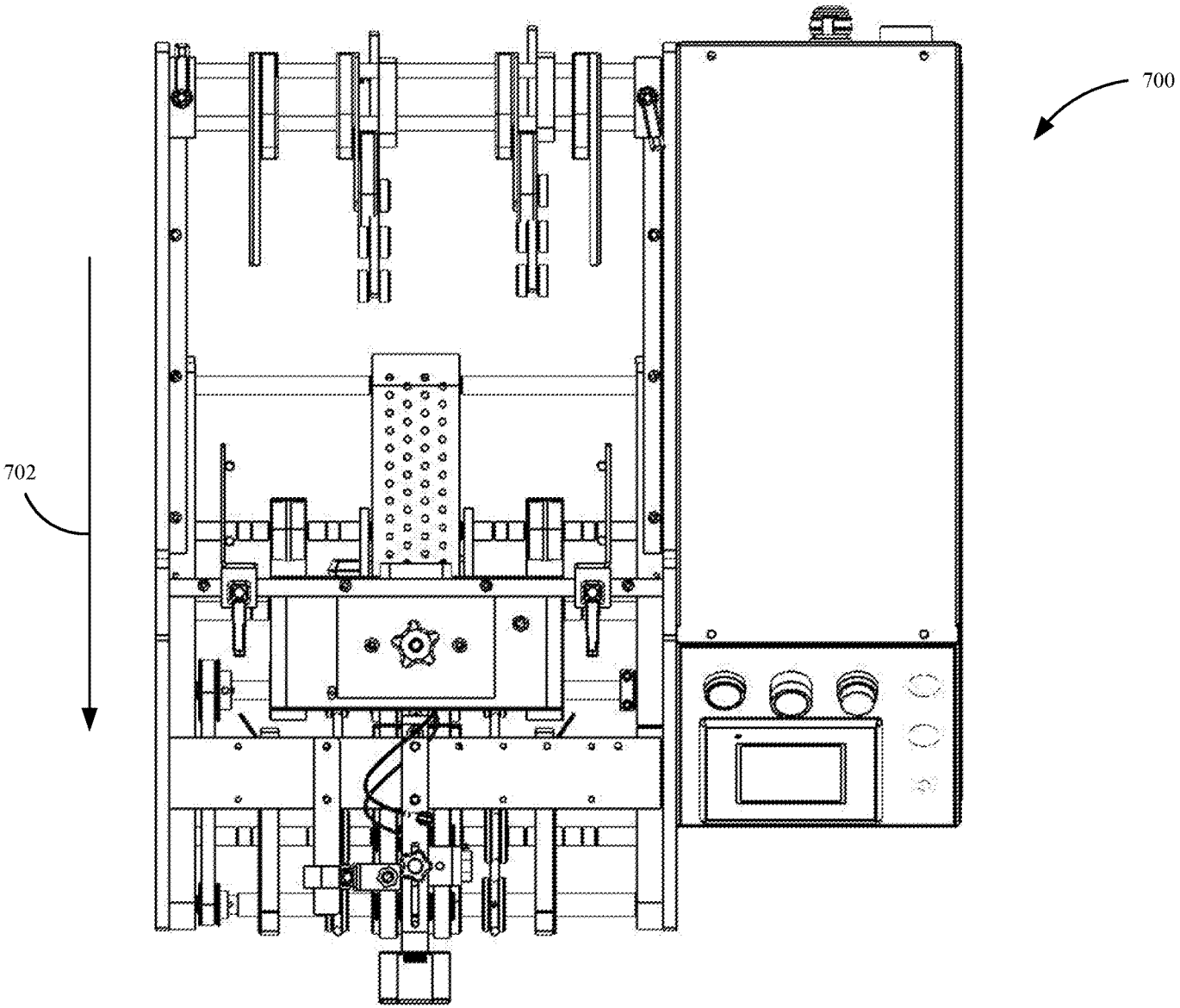
Figure 7C:
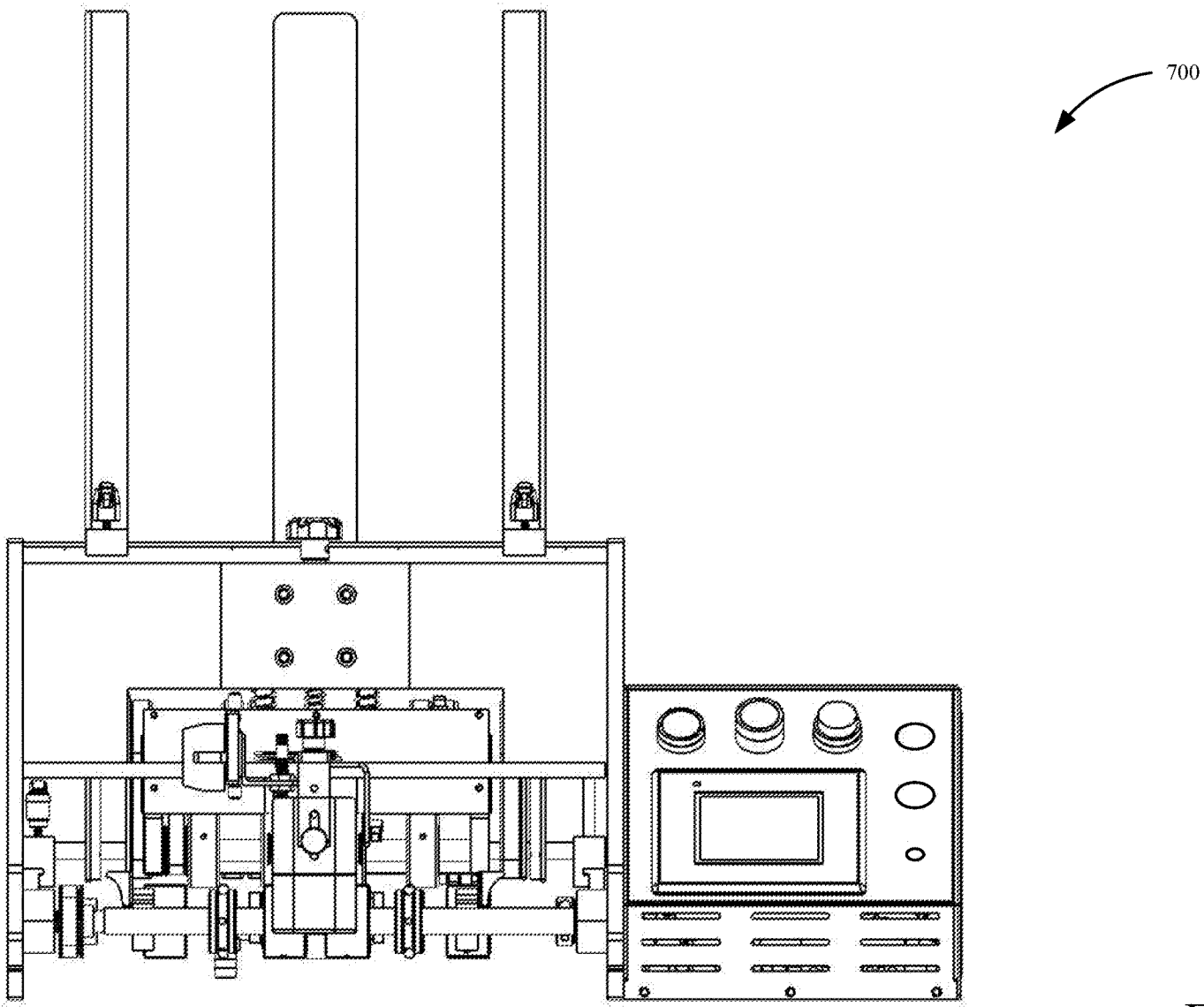
Figure 7D:
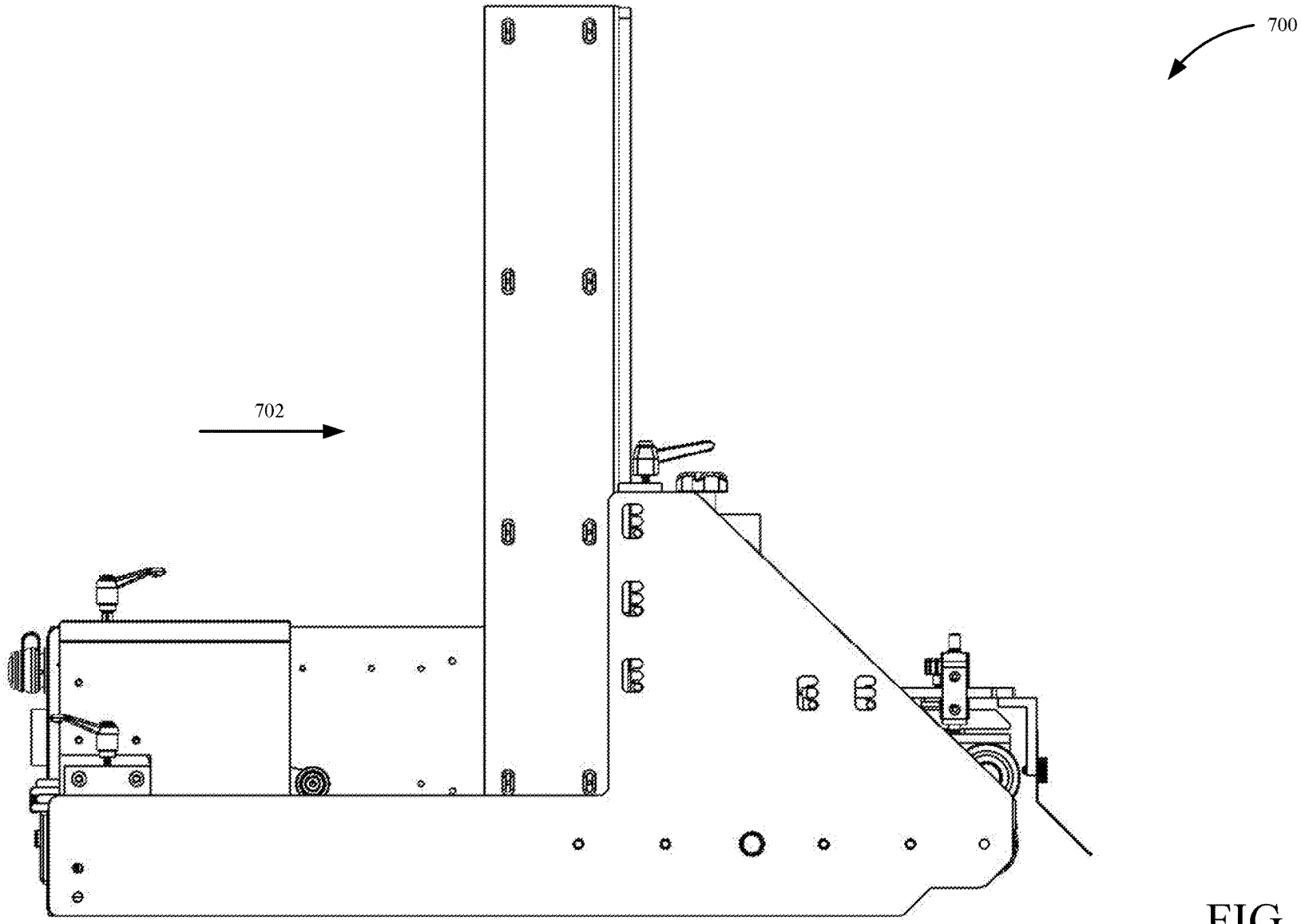
Figure 7E:
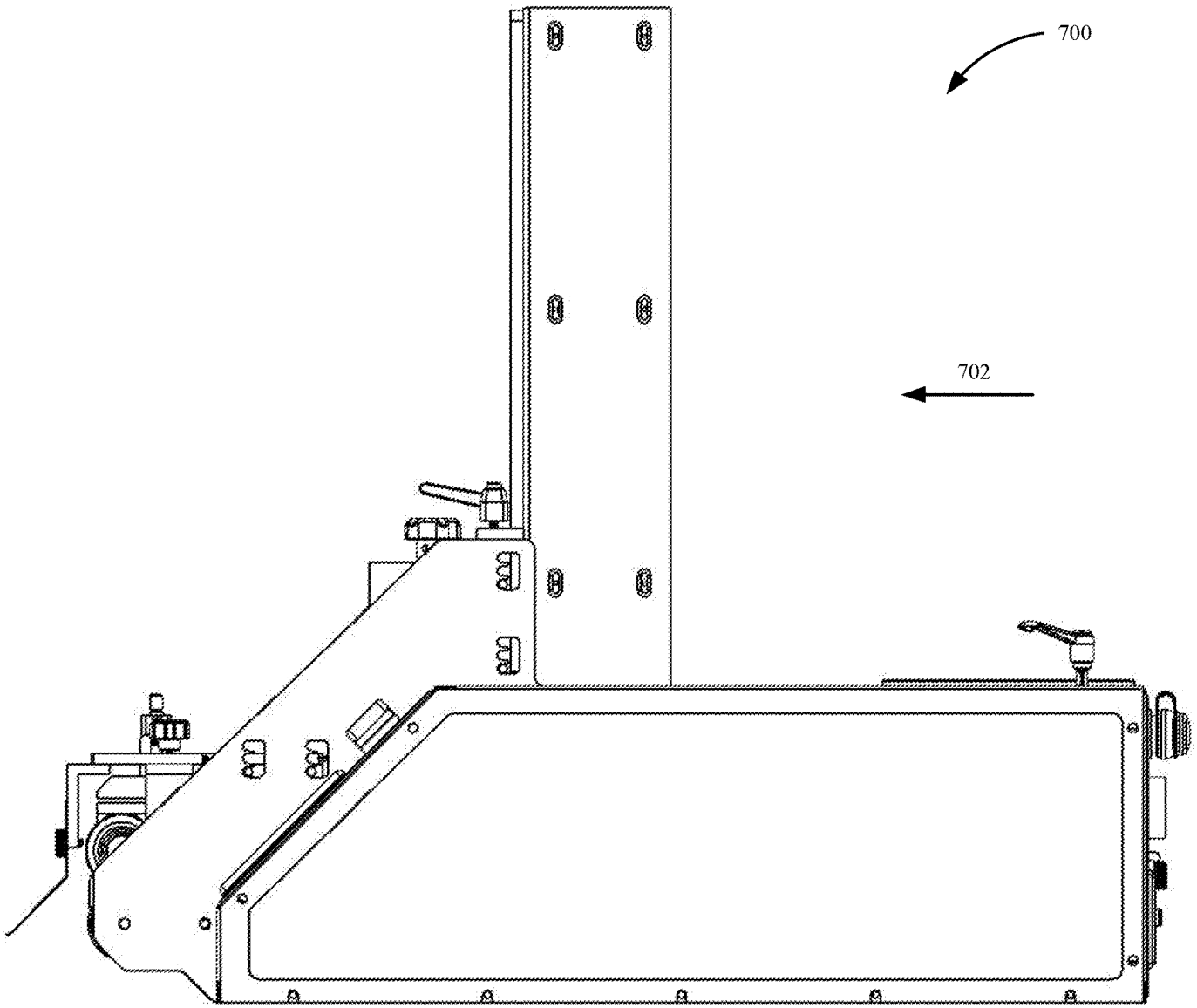

FIG. 7B illustrates a top view of friction feeder 700. FIG. 7C illustrates a front view of friction feeder 700. FIGS. 7D and 7E illustrate first and second side views of friction feeder 700.

Figure 7F:
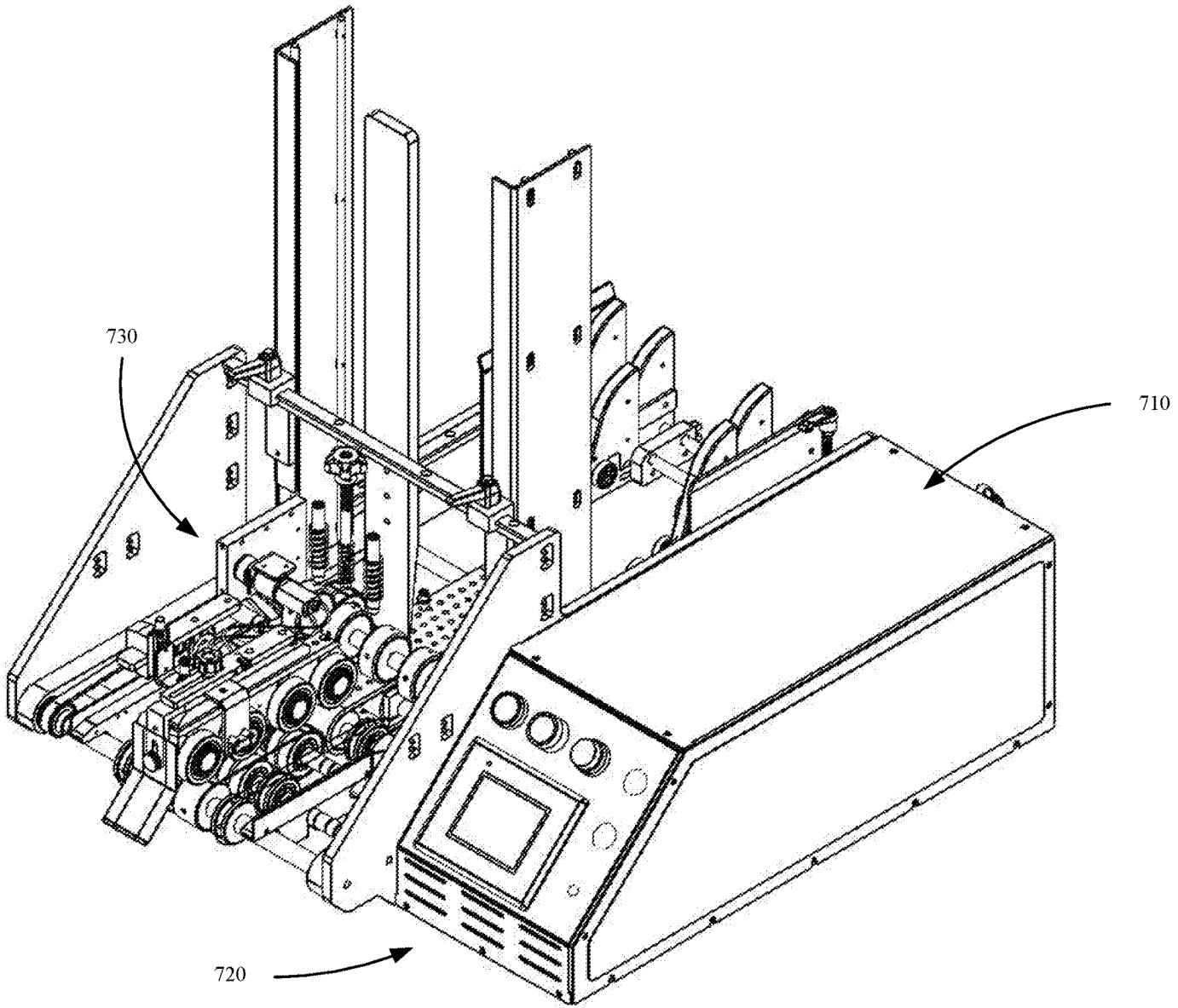

FIG. 7F illustrates a view of friction feeder 700 with components 732 removed for ease of illustration. Separation mechanism 730 is illustrated in greater detail. In one embodiment, separation mechanism 730 is driven by motor within housing 710, according to a program run by a controller.

It will be noted that the above discussion has described a variety of different systems, components and/or logic. It will be appreciated that such systems, components and/or logic can be comprised of hardware items (such as processors and associated memory, or other processing components, some of which are described below) that perform the functions associated with those systems, components and/or logic. In addition, the systems, components and/or logic can be comprised of software that is loaded into a data storage and is subsequently executed by a processor or server, or other computing component, as described below. The systems, components and/or logic can also be comprised of different combinations of hardware, software, firmware, etc., some examples of which are described below. These are only some examples of different structures that can be used to form the systems, components and/or logic described above. Other structures can be used as well.

The present discussion has mentioned controllers, processors and servers. In one embodiment, the processors and servers include computer processors with associated memory and timing circuitry, not separately shown. They are functional parts of the systems or devices to which they belong and are activated by, and facilitate the functionality of the other components or items in those systems.

Also, a number of user interface displays have been discussed. They can take a wide variety of different forms and can have a wide variety of different user actuatable input mechanisms disposed thereon. For instance, the user actuatable input mechanisms can be text boxes, check boxes, icons, links, drop-down menus, search boxes, etc. They can also be actuated in a wide variety of different ways. For instance, they can be actuated using a point and click device (such as a track ball or mouse). They can be actuated using hardware buttons, switches, a joystick or keyboard, thumb switches or thumb pads, etc. They can also be actuated using a virtual keyboard or other virtual actuators. In addition, where the screen on which they are displayed is a touch sensitive screen, they can be actuated using touch gestures. Also, where the device that displays them has speech recognition components, they can be actuated using speech commands.

A number of data stores have also been discussed. It will be noted they can each be broken into multiple data stores. All can be local to the systems accessing them, all can be remote, or some can be local while others are remote. All of these configurations are contemplated herein.

Also, the figures show a number of blocks with functionality ascribed to each block. It will be noted that fewer blocks can be used so the functionality is performed by fewer components. Also, more blocks can be used with the functionality distributed among more components.

Figure 8:
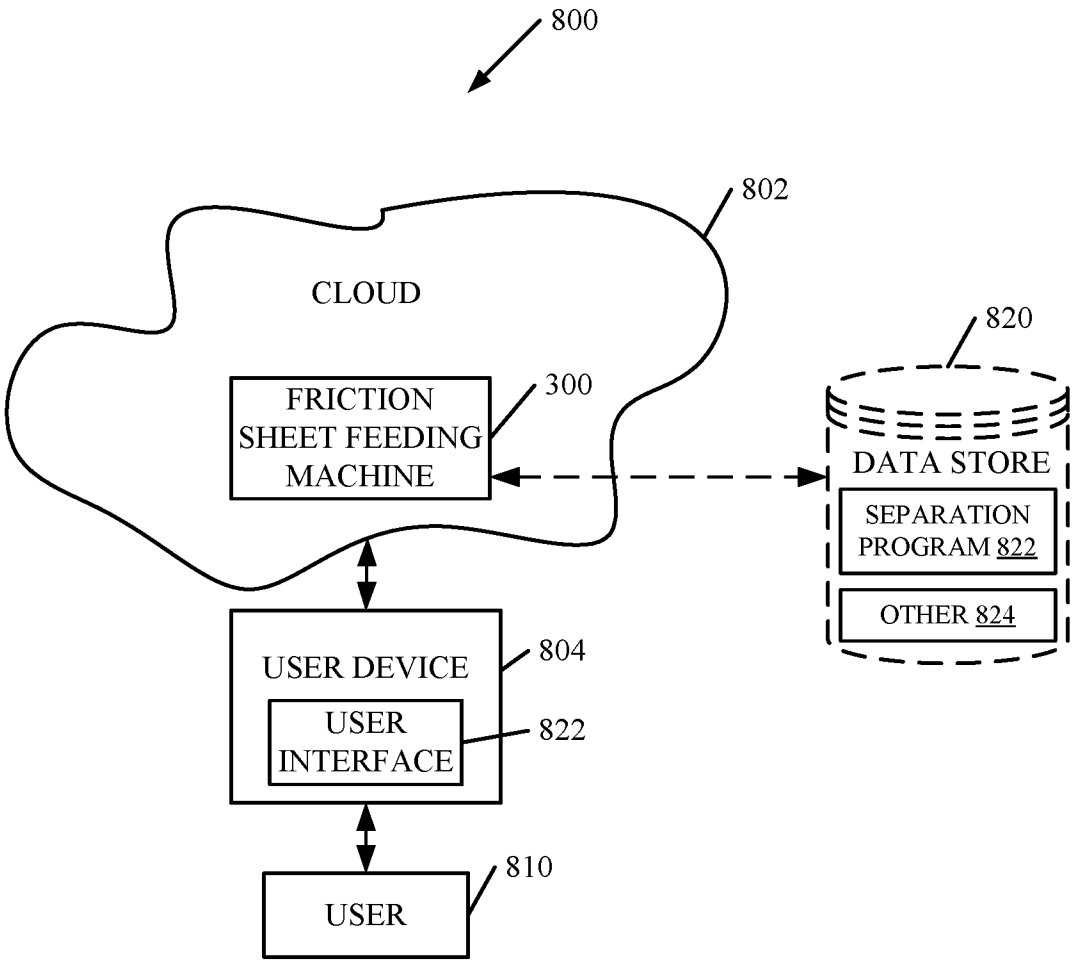
FIG. 8 is a block diagram showing one example of the architecture shown in FIG. 3, deployed in a cloud computing architecture.

FIG. 8 is a block diagram of architecture 300, shown in FIG. 3, except that its elements are disposed in a cloud computing architecture 800. Cloud computing provides computation, software, data access, and storage services that do not require end-user knowledge of the physical location or configuration of the system that delivers the services. In various embodiments, cloud computing delivers the services over a wide area network, such as the internet, using appropriate protocols. For instance, cloud computing providers deliver applications over a wide area network and they can be accessed through a web browser or any other computing component. Software or components of architecture 300 as well as the corresponding data, can be stored on servers at a remote location. The computing resources in a cloud computing environment can be consolidated at a remote data center location or they can be dispersed. Cloud computing infrastructures can deliver services through shared data centers, even though they appear as a single point of access for the user. Thus, the components and functions described herein can be provided from a service provider at a remote location using a cloud computing architecture. Alternatively, they can be provided from a conventional server, or they can be installed on client devices directly, or in other ways.

The description is intended to include both public cloud computing and private cloud computing. Cloud computing (both public and private) provides substantially seamless pooling of resources, as well as a reduced need to manage and configure underlying hardware infrastructure.

A public cloud is managed by a vendor and typically supports multiple consumers using the same infrastructure. Also, a public cloud, as opposed to a private cloud, can free up the end users from managing the hardware. A private cloud may be managed by the organization itself and the infrastructure is typically not shared with other organizations. The organization still maintains the hardware to some extent, such as installations and repairs, etc.

In the example shown in FIG. 8, some items are similar to those shown in FIG. 3 and they are similarly numbered. FIG. 8 specifically shows that friction sheet feeding machine 300 can be located in cloud 802 (which can be public, private, or a combination where portions are public while others are private). Therefore, user 810 uses a user interface 822, on a user device 804, to access those systems through cloud 802.

It will also be noted that architecture 300, or portions of it, can be disposed on a wide variety of different devices. Some of those devices include servers, desktop computers, laptop computers, tablet computers, or other mobile devices, such as palm top computers, cell phones, smart phones, multimedia players, personal digital assistants, etc.

Figure 9:
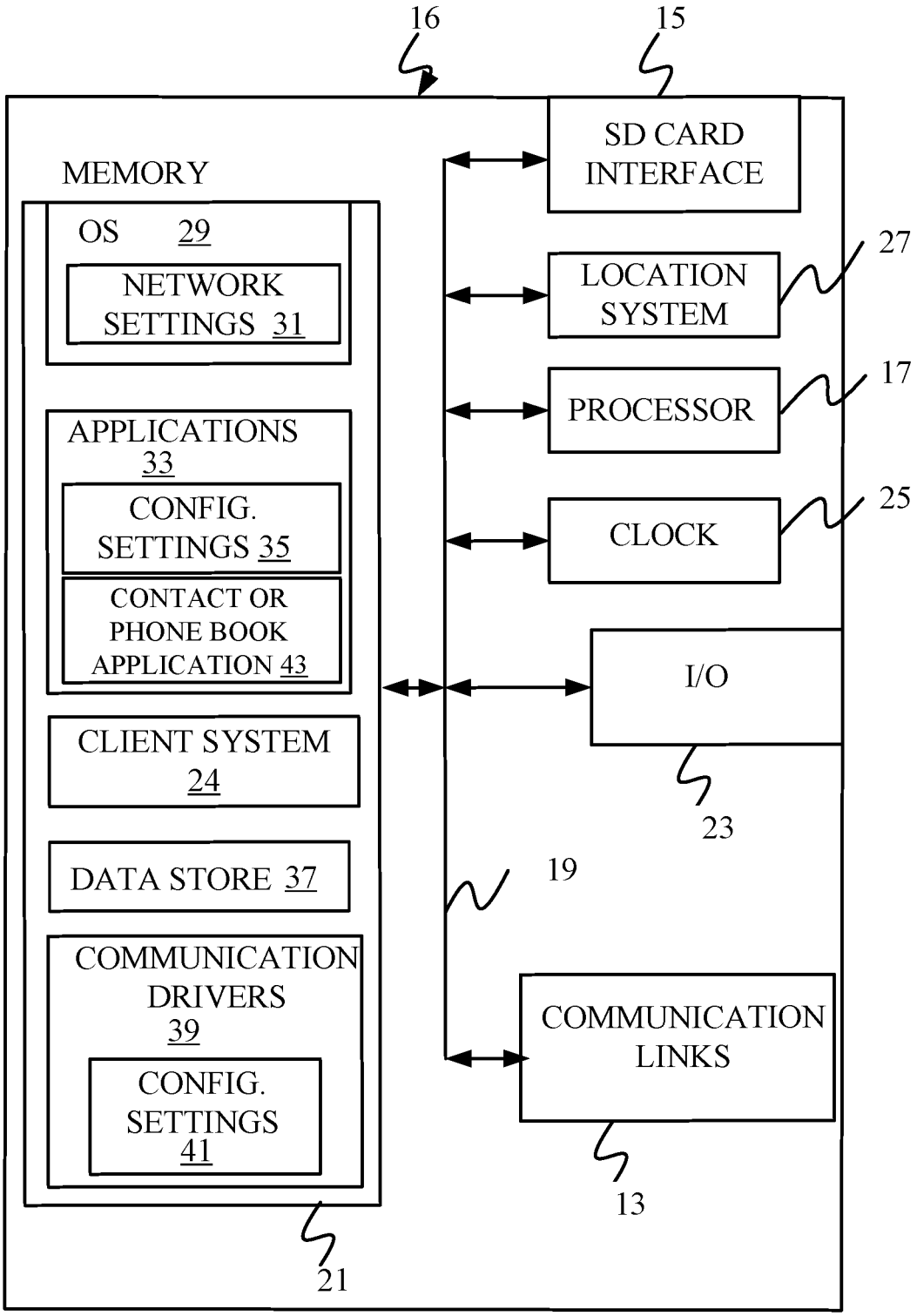
FIGS. 9-10 show examples of mobile devices that can be used in the architectures shown in the previous figures.
Figure 10:
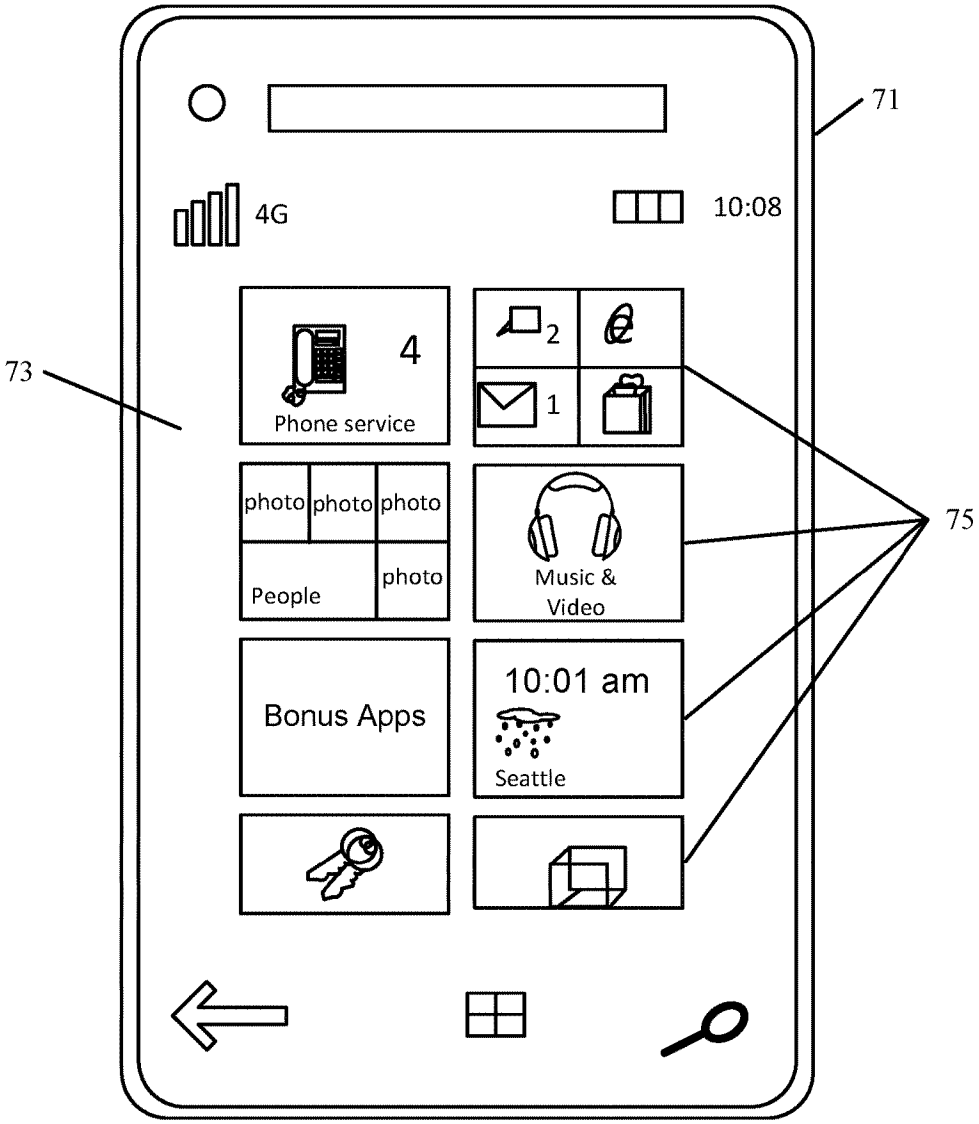

FIG. 9 is a simplified block diagram of one illustrative example of a handheld or mobile computing device that can be used as a user's or client's hand held device 16, in which the present system (or parts of it) can be controlled. FIGS. 9-10 are examples of handheld or mobile devices.

FIG. 9 provides a general block diagram of the components of a client device 16 that can run components of friction sheet feeding machine 300. In the device 16, a communications link 13 is provided that allows the handheld device to communicate with other computing devices and under some embodiments provides a channel for receiving information automatically, such as by scanning Examples of communications link 13 include an infrared port, a serial/USB port, a cable network port such as an Ethernet port, and a wireless network port allowing communication though one or more communication protocols including General Packet Radio Service (GPRS), LTE, HSPA, HSPA+ and other 3G and 4G radio protocols, 1×rtt, and Short Message Service, which are wireless services used to provide cellular access to a network, as well as Wi-Fi protocols, and Bluetooth protocol, which provide local wireless connections to networks.

In other examples, applications or systems are received on a removable Secure Digital (SD) card that is connected to a SD card interface 15. SD card interface 15 and communication links 13 communicate with a processor 17 (which can also embody processors or servers from other FIGS.) along a bus 19 that is also connected to memory 21 and input/output (I/O) components 23, as well as clock 25 and location system 27.

I/O components 23, in one embodiment, are provided to facilitate input and output operations. I/O components 23 for various embodiments of the device 16 can include input components such as buttons, touch sensors, multi-touch sensors, optical or video sensors, voice sensors, touch screens, proximity sensors, microphones, tilt sensors, and gravity switches and output components such as a display device, a speaker, and or a printer port. Other I/O components 23 can be used as well.

Clock 25 illustratively comprises a real time clock component that outputs a time and date. It can also, illustratively, provide timing functions for processor 17.

Location system 27 illustratively includes a component that outputs a current geographical location of device 16. This can include, for instance, a global positioning system (GPS) receiver, a LORAN system, a dead reckoning system, a cellular triangulation system, or other positioning system. It can also include, for example, mapping software or navigation software that generates desired maps, navigation routes and other geographic functions.

Memory 21 stores operating system 29, network settings 31, applications 33, application configuration settings 35, data store 37, communication drivers 39, and communication configuration settings 41. Memory 21 can include all types of tangible volatile and non-volatile computer-readable memory devices. It can also include computer storage media (described below). Memory 21 stores computer readable instructions that, when executed by processor 17, cause the processor to perform computer-implemented steps or functions according to the instructions. Processor 17 can be activated by other components to facilitate their functionality as well.

Examples of the network settings 31 include things such as proxy information, Internet connection information, and mappings. Application configuration settings 35 include settings that tailor the application for a specific enterprise or user. Communication configuration settings 41 provide parameters for communicating with other computers and include items such as GPRS parameters, SMS parameters, connection user names and passwords.

Applications 33 can be applications that have previously been stored on the device 16 or applications that are installed during use, although these can be part of operating system 29, or hosted external to device 16, as well.

FIG. 10 shows that the device can be a smart phone 71. Smart phone 71 has a touch sensitive display 73 that displays icons or tiles or other user input mechanisms 75. Mechanisms 75 can be used by a user to run applications, make calls, perform data transfer operations, etc. In general, smart phone 71 is built on a mobile operating system and offers more advanced computing capability and connectivity than a feature phone.

Note that other forms of the devices 16 are possible.

Figure 11:
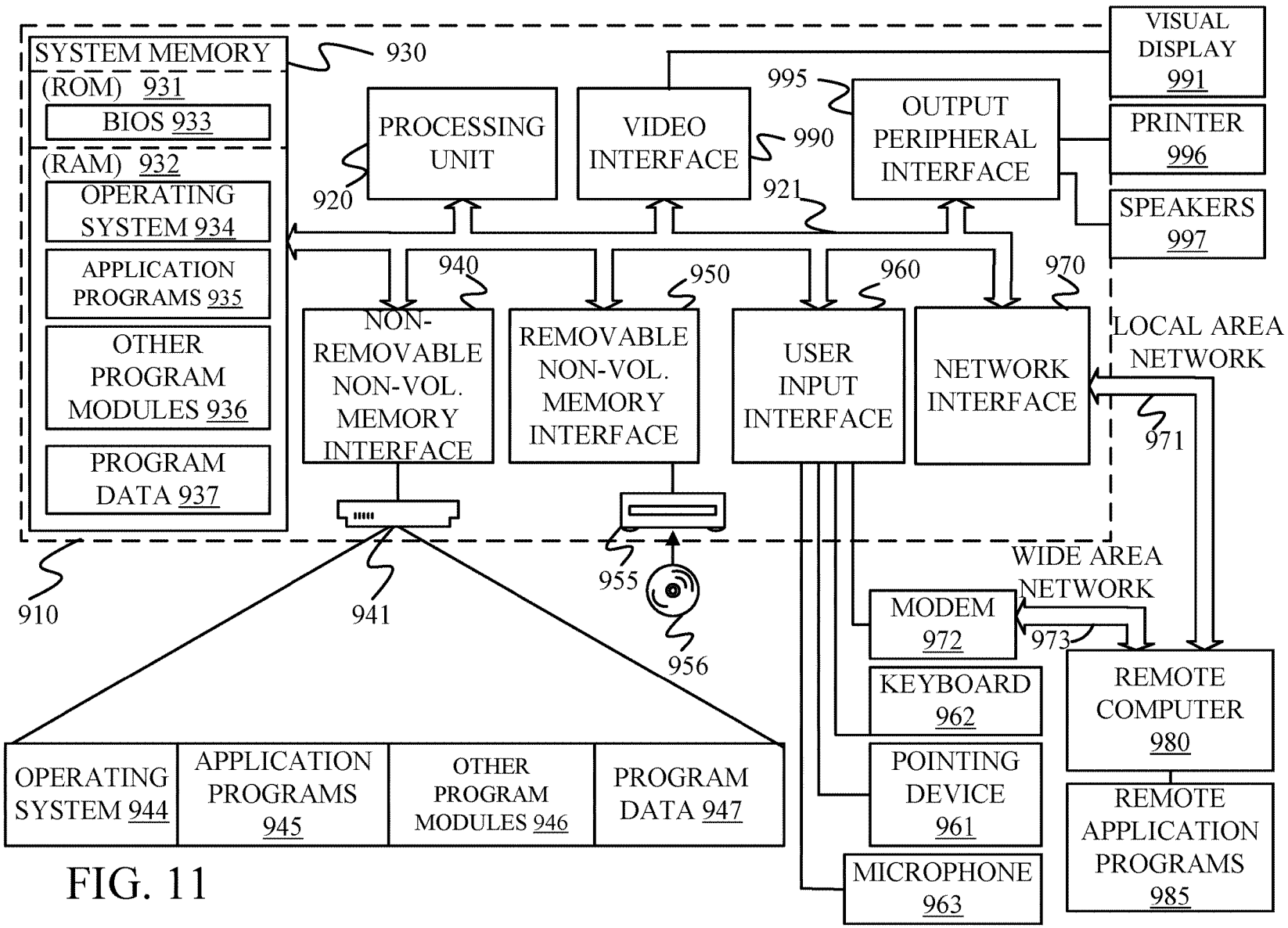
FIG. 11 is a block diagram showing one example of a computing environment that can be used in the architectures shown in the previous figures.

FIG. 11 is one example of a computing environment in which a controller for machine 300, or parts of it, (for example) can be deployed. With reference to FIG. 11, an example system for implementing some embodiments includes a general-purpose computing device in the form of a computer 910. Components of computer 910 may include, but are not limited to, a processing unit 920 (which can comprise processors or servers from previous FIGS.), a system memory 930, and a system bus 921 that couples various system components including the system memory to the processing unit 920. The system bus 921 may be any of several types of bus structures including a memory bus or memory controller, a peripheral bus, and a local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus also known as Mezzanine bus.

Computer 910 typically includes a variety of computer readable media. Computer readable media can be any available media that can be accessed by computer 910 and includes both volatile and nonvolatile media, removable and non-removable media. By way of example, and not limitation, computer readable media may comprise computer storage media and communication media. Computer storage media is different from, and does not include, a modulated data signal or carrier wave. It includes hardware storage media including both volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by computer 910. Communication media typically embodies computer readable instructions, data structures, program modules or other data in a transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of any of the above should also be included within the scope of computer readable media.

The system memory 930 includes computer storage media in the form of volatile and/or nonvolatile memory such as read only memory (ROM) 931 and random access memory (RAM) 932. A basic input/output system 933 (BIOS), containing the basic routines that help to transfer information between elements within computer 910, such as during start-up, is typically stored in ROM 931. RAM 932 typically contains data and/or program modules that are immediately accessible to and/or presently being operated on by processing unit 920. By way of example, and not limitation, FIG. 11 illustrates operating system 934, application programs 935, other program modules 936, and program data 937.

The computer 910 may also include other removable/non-removable volatile/nonvolatile computer storage media. By way of example only, FIG. 11 illustrates a hard disk drive 941 that reads from or writes to non-removable, nonvolatile magnetic media, and an optical disk drive 955 that reads from or writes to a removable, nonvolatile optical disk 956 such as a CD ROM or other optical media. Other removable/non-removable, volatile/nonvolatile computer storage media that can be used in the exemplary operating environment include, but are not limited to, magnetic tape cassettes, flash memory cards, digital versatile disks, digital video tape, solid state RAM, solid state ROM, and the like. The hard disk drive 941 is typically connected to the system bus 921 through a non-removable memory interface such as interface 940, and optical disk drive 955 are typically connected to the system bus 921 by a removable memory interface, such as interface 950.

The drives and their associated computer storage media discussed above and illustrated in FIG. 11, provide storage of computer readable instructions, data structures, program modules and other data for the computer 910. In FIG. 11, for example, hard disk drive 941 is illustrated as storing operating system 944, application programs 945, other program modules 946, and program data 947. Note that these components can either be the same as or different from operating system 834, application programs 935, other program modules 936, and program data 937. Operating system 944, application programs 945, other program modules 946, and program data 947 are given different numbers here to illustrate that, at a minimum, they are different copies.

A user may enter commands and information into the computer 910 through input devices such as a keyboard 962, a microphone 963, and a pointing device 961, such as a mouse, trackball or touch pad. Other input devices (not shown) may include a joystick, game pad, satellite dish, scanner, or the like. These and other input devices are often connected to the processing unit 920 through a user input interface 960 that is coupled to the system bus, but may be connected by other interface and bus structures, such as a parallel port, game port or a universal serial bus (USB). A visual display 991 or other type of display device is also connected to the system bus 921 via an interface, such as a video interface 990. In addition to the monitor, computers may also include other peripheral output devices such as speakers 997 and printer 996, which may be connected through an output peripheral interface 995.

The computer 910 is operated in a networked environment using logical connections to one or more remote computers, such as a remote computer 980. The remote computer 980 may be a personal computer, a hand-held device, a server, a router, a network PC, a peer device or other common network node, and typically includes many or all of the elements described above relative to the computer 910. The logical connections depicted in FIG. 11 include a local area network (LAN) 971 and a wide area network (WAN) 973, but may also include other networks. Such networking environments are commonplace in offices, enterprise-wide computer networks, intranets and the Internet.

It should also be noted that the different embodiments described herein can be combined in different ways. That is, parts of one or more embodiments can be combined with parts of one or more other embodiments. All of this is contemplated herein.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A friction sheet feeding machine comprising:

a hopper configured to hold a stack of items;

a receiver configured to receive an item from the stack of items;

a separating mechanism configured to separate the item from the stack of items, wherein the separating mechanism comprises a drive mechanism configured to operate in a forward direction and a reverse direction;

a user input mechanism configured to receive a user input defining a direction, speed, and time for operation of the drive mechanism; and a controller configured to generate control signals to the drive mechanism based on the user input.

2. The friction sheet feeding machine of claim 1 and further comprising:

a first user input defining a direction, speed, and time for a first operation of the drive mechanism; and a second user input defining a direction, speed, and time for a second operation of the drive mechanism, wherein the first and second drive operations have a different combination of direction, speed, and time.

3. The friction sheet feeding machine of claim 1, wherein the direction comprises a first direction and a second direction, wherein the first and second directions are different.

4. The friction sheet feeding machine of claim 3, wherein the drive mechanism is operated in the first direction at a first speed and operated in the second direction at a second speed, wherein the first and second speeds are different.

5. The friction sheet feeding machine of claim 3, wherein the drive mechanism is operated in the first direction for a first time and operated in the second direction for a second time, wherein the first and second times are different.

6. The friction sheet feeding machine of claim 1, wherein the user input mechanism comprises a touchscreen device.

7. The friction sheet feeding machine of claim 1, wherein the user input mechanism is displayed on a touchscreen device and is user actuatable.

8. The friction sheet feeding machine of claim 1, wherein the user input is based on a characteristic of the item in the stack of items.

9. The friction sheet feeding machine of claim 8, wherein the characteristic comprises a type of material of the item in the stack of items.

10. The friction sheet feeding machine of claim 8, wherein the characteristic comprises a dimension of the item in the stack of items.

11. A method of separating an item from a stack of items in a hopper of a friction sheet feeding machine, the method comprising:

receiving a user input defining a direction, speed, and time for operation of a drive mechanism of the friction sheet feeding machine that drives a separating mechanism, the drive mechanism being configured to operate in a forward and a reverse direction;

generating a control signal to the drive mechanism based on the user input;

separating the item from the stack of items in the hopper with the separating mechanism; and receiving the item from the stack of items at a receiver of the friction sheet feeding machine.

12. The method of claim 11, wherein the user input comprises:

a first user input defining a direction, speed, and time for a first operation, of the drive mechanism; and a second user input defining a direction, speed, and time for a second operation of the drive mechanism, wherein the first and, second drive operations have a different combination of direction, speed, and time.

13. The method of claim 11, wherein the direction comprises a first direction and second direction, wherein the first and second directions are different.

14. The method of claim 13, wherein the drive mechanism is operated in the first direction at a first speed and operated in the second direction at a second, speed, wherein the first and second speeds are different.

15. The method of claim 13, wherein the drive mechanism is operated in the first direction for a first time and operated in the second direction fore a second time, wherein the first and second times are different.

16. The method of claim 11, wherein the user input mechanism comprises a touchscreen device.

17. The method of claim 11, wherein the user input mechanism is displayed on a touchscreen device and is user actuatable.

18. The method of claim 11, wherein the user input is based on a characteristic of the item in the stack of items.

19. The method of claim 18, wherein the characteristic comprises a type of material of the item in the stack of items.

20. The method of claim 18, wherein the characteristic comprises a dimension of the item in the stack of items.

* * * * *